United States Patent [19]

Spenceley et al.

[11] Patent Number: 4,694,889

[45] Date of Patent: Sep. 22, 1987

[54] COOLING OF MATERIALS

[75] Inventors: Gene D. Spenceley, Stokesley; Steven Henderson, Middlesbrough, both of England

[73] Assignee: British Steel Corporation, Great Britain

[21] Appl. No.: 723,508

[22] Filed: Apr. 15, 1985

Related U.S. Application Data

[63] Continuation-in-part of Ser. No. 471,847, Mar. 3, 1983, abandoned.

[30] Foreign Application Priority Data

Mar. 11, 1982 [GB] United Kingdom ..... 8207155

[51] Int. Cl.[4] ..... B22D 11/10; B22D 1/00

[52] U.S. Cl. ..... 164/488; 164/122; 164/133; 222/592

[58] Field of Search ..... 164/437, 438, 488, 489, 164/122, 133, 900; 222/592

[56] References Cited

U.S. PATENT DOCUMENTS 3,570,713 3/1971 Tromel ..... 222/592

4,580,616 4/1986 Watts ..... 164/122

*Primary Examiner*—Nicholas P. Godici

*Assistant Examiner*—Richard K. Seidel

*Attorney, Agent, or Firm*—Bacon & Thomas

[57] ABSTRACT

The invention provides an arrangement for producing solid metal with fine solidification structure from liquid metal including the steps of transferring liquid metal with a minimum flow through a hollow carrier; the minimum bulk velocity of the metal through the carrier being 50 cm/sec.

6 Claims, 4 Drawing Figures

COOLING OF MATERIALS

This application is a continuation-in-part of our copending U.S. application Ser. No. 471,847, filed Mar. 3, 1983, now abandoned.

This invention relates to methods of the production of solid metal with fine solidification structure from liquid metal. Particularly, although not exclusively, this invention relates to the shaping of such metals. More particularly, although again not exclusively, it relates to the casting of castable materials.

In casting operations of castable materials such as metals (including ingot casting and continuous casting), the metals are commonly cast with sufficient contained heat to ensure that the metal passes through any nozzle, runner or grating system or similar transfer system associated with the mould in a molten state without flow blockage and other refractory containment problems associated with metal skull build-up. To achieve this situation the molten metal is normally aimed to enter the ingot or mould above the liquidus temperature. In such arrangements it can be said that the solidification of the metal thereafter is essentially directional and can be likened to an advancing wall towards the centre of the casting. The rate of heat extraction and therefore plant throughput rate are determined and constrained by the rate of heat transfer through the solidified portion.

The characteristics of the cast structure are determined by the metallurgical characteristics of the metal cast, the degree of initial superheat and the rate of heat extraction from the system. Thus, for example, in chill cast steels the cast structures usually consist of a very thin chill zone at the periphery which comprises the portion of the steel solidified on contact with the mould, a prominent columnar dendritic zone and a central equiaxed zone. The directional nature of the solidification causes compositional inhomogeneity across the casting, i.e. macro-segregation. Thus, the purer phases solidify first leaving a solute-enriched liquid to solidify in the later stages of the overall solidification process. The cast structure is therefore inhomogeneous physically and chemically and may be inherently weak and commonly requires further mechanical working to break it down and develop the necessary potential strength of the material.

As well as the above deficiencies, casting with superheat is accompanied by proportionate shrinkage which may manifest itself as porosity or shrinkage cavities. Attempts have been made to alleviate at least some of these difficulties, for example by electromagnetic stirring in continuous casting moulds, or by tundish or ladle casting with minimal superheat. However, significant problems remain. Thus, with electromagnetic stirring there are difficulties in achieving efficient stirring during the final stages of solidification, and with casting with minimal superheat difficulties arise with yield loss due to skull formation.

It is an object of the present invention to provide a method which, amongst other things, enables the above-mentioned problems to be overcome at least substantially reduced.

According to the present invention there is provided a method of producing solid metal with a substantially fine non-linear, degenerate or globulor solidification structure from liquid metal comprising the steps of transferring liquid metal with minimum flow through a hollow carrier; the minimum bulk or mean velocity through the carrier being arranged to be 50 cm/sec, whereby creating a temperature profile of the liquid metal across the carrier such that the temperature at the carrier axis is greater than the temperature at the wall of the carrier.

We believe that there is a maximum carrier length to hydraulic diameter ratio which can be used for the carrier for a given melt bulk velocity and initial superheat. For steel of initial superheat +30° C. and melt bulk velocity of 50 cm/s the maximum length of hydraulic diameter ratio permissable for the carrier is 50.

We have found that the invention enables the production of fine solidification structures from liquid metals and imparting to these structures a substantially globular nature of the primary solids and significantly reduce the dendritic linear character of the solidification structure.

Limitation of the linear solidification features such as columnar dendrites and associated defects can be achieved if the liquid metal contains a substantial proportion of solids derived from the melt itself.

We believe that such a liquid metal can be generated, through a hollow carrier with a temperature profile set up transverse to the melt flow such that a substantial portion of the section is below the liquidus of the melt but above its solidus. In such conditions a shell forms inside the carrier and is likely to grow until the bore of the carrier is completely blocked. To prevent blockage of the carrier by the shell growth, the metal flow rate should be such that it has a minimum bulk velocity (as provided by the invention) capable of providing the necessary shear forces at the liquid/solid interface to break up the growing dendrite tips in the shell and maintain low viscosity in the melt which may now contain a solids fraction. If the average superheat in the melt is zero or negative then it is especially important to maintain high shear rates within the melt.

The shear force at the wall ($\tau$) and the melt bulk velocity (V) are related as follows:

$$\tau = \frac{f}{2} \rho V^2 \quad (1)$$

where $\rho$ is the density of the melt and f is the friction factor at the melt/solid boundary.

Since $\rho$ and f are constants for a particular system the required shear forces can be defined by the bulk viscosity of the melt in the carrier. For metals such as liquid steel the minimum required bulk velocity is 50 cm/s.

The invention may include the shaping of metals and may incorporate a molten metal containing vessel and/or delivery system, a shaping station and a hollow carrier as hereinabove specified for transferring molten metal to the shaping station.

The invention is particularly applicable to the casting of metals but can also be used in connection with other techniques for treating metals in what can generally be described as "shaping" techniques. Thus, where the shaping technique is the casting of the metal concerned, the metal is transferred via the hollow carrier to a casting mould. Alternatively, where the shaping technique is rolling, or extruding or forging, for example, the material is transferred via the hollow carrier to a rolling station, an extruder or a forging station respectively.

By means of the invention it is possible to provide for the metal emergent from the hollow carrier to be at a below liquidus in, for example, the casting of metals, whilst still maintaining sufficient fluidity to enable casting to take place with no significant skulling problem of the kind mentioned above. Hence, less heat needs to be removed from the metal in the casting mould, and the directional nature of solidification is significantly modified with corresponding metallurgical advantages. Alternatively it is possible to extract a portion only of the sensible superheat of the liquid metal so that the liquid metal (or other material) can be cast at lower superheat.

The present invention is particularly, but by no means solely, applicable in connection with the production of high quality steel on a commercial scale in ingot casting, continuous casting or continuous forming plants.

The hollow carrier may be in the form of a pipe or an open-topped gully or channel for example.

The hollow carrier may be horizontal, vertical or at some angle to the vertical.

The carrier may be constructed from metal, ceramic, cermet or composite material and heat may be extracted therefrom by natural convection in the atmosphere with or without cooling fins; by water cooling by jet, sprays, high-pressure mists or cooling coil or jackets; or by high pressure gas cooling systems; or by fluidised beds of solid materials.

The carrier may be disposable after a single cast or re-usable depending upon its material and form of construction.

The carrier may, at least internally, be of any appropriate section such as round or square, and be of changing section, e.g. tapered along its length.

The driving force for providing the minimum bulk velocity of flow through the hollow carrier may, for example, be gravity such as by a pressure head in an associated tundish, which may or may not be throttled, a vacuum in the receiving vessel, or a syphonic system.

The heat transfer characteristics of the pipe and the heat transfer and temperature profiles within the pipe are of importance.

The shear rates within the fluid in the pipe may be enhanced by vibration, electromagnetic stirring, or gas injection, for example. The shear rates may also be enhanced by suitable profiling of the pipe, for example, by "rifling" or ribbing or by use of protrusions.

In order that the invention may be more readily understood, two embodiments thereof will now be described by way of example with reference to the accompanying drawings in which.

Figure 1:
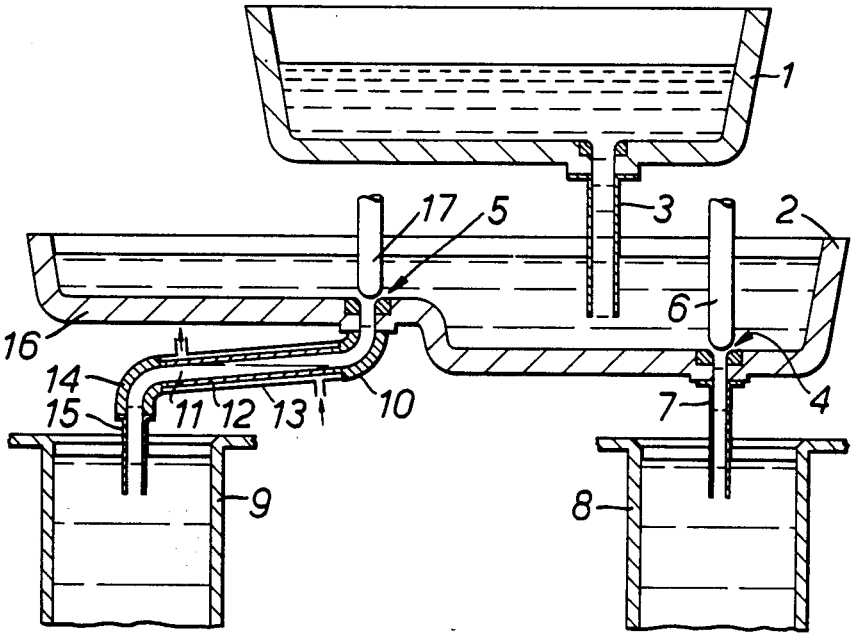
FIG. 1 is a diagrammatic representation of a steel slab continuous casting apparatus incorporating the invention for the production of refined solidification structures.

Referring to FIG. 1, it will be seen that the continuous casting apparatus comprises a ladle 1 from which metal is poured into a tundish 2, via a shroud pipe 3. The tundish 2 has a two straned output from separate outlets 4 and 5.

Outlet 4, controlled by a stopper rod 6 feeds in a conventional manner via a shroud tube 7 to a slab mould 8 of a continuous casting machine (not shown) of a conventional design.

Outlet 5 also feeds to a slab mould 9 of a conventional continuous casting machine (not shown). In this case, however, the outlet is connected via a refractory insert 10, to a water cooled transfer pipe 11 having an inner wall 12 of copper and an outer wall 13 of steel. Thereafter, via a further refractory inser 14 the feed is through a shroud tube 15 to the slab mould 9. It will be seen that in order physically to accommodate the transfer pipe 11 between tundish 2 and the mould 9, part of the base 16 of the tundish is at an elevated level. The dimensions of the transfer pipe are so chosen, using the calculation mentioned hereinabove, to ensure turbulent flow for the metal passing therethrough.

During operation heat is extracted from the metal flowing through the transfer pipe 11 so that, on entry to the continuous casting mould, it is at, near or below liquidus temperature. Heat extraction as illustrated is by water cooling.

Control of metal flow from outlet 5 is by means of a metering stopper rod 17 which can be adjusted to provide steady state flow through the pipe 11 adjusted any skull formation occurring therein. With apparatus of the kind illustrated metal flow rates of the order of 2½ Tonnes per minute are anticipated.

Figure 2:
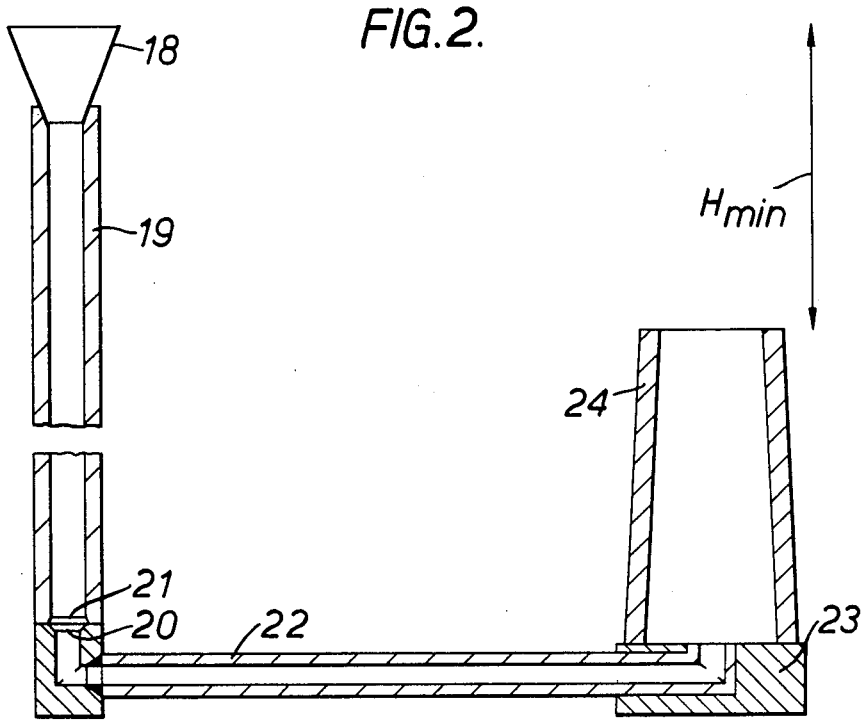
FIG. 2 is a diagrammatic representation of uphill teeming apparatus incorporating the invention for the production of substantially globular structures.

In FIG. 2 liquid steel is teemed into a trumpet 18 leading to a refractory down-runner 19, which has a restriction 20 near its base and a delay plate 21 of, for example, aluminium, steel, or cardboard at or near the base which allows the down-runner 19 to fill before the delay plate melts or breaks allowing the metal to flow through a seamless thick-walled steel tube 22 through a mould base 23 and into a casting mould 24. The height of the trumpet 18 and mould 24 can be maintained throughout the casting period. The tube 22 is constructed so as to allow substantial heat extracton from the molten metal simply by means of exposure to ambient temperature.

Figure 3:
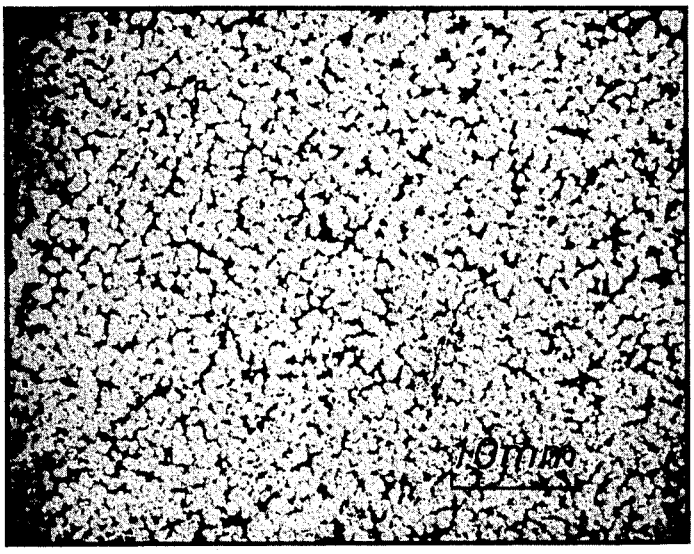
FIGS. 3 and 4 are representations of microstructure of steel samples by means of the invention.
Figure 4:
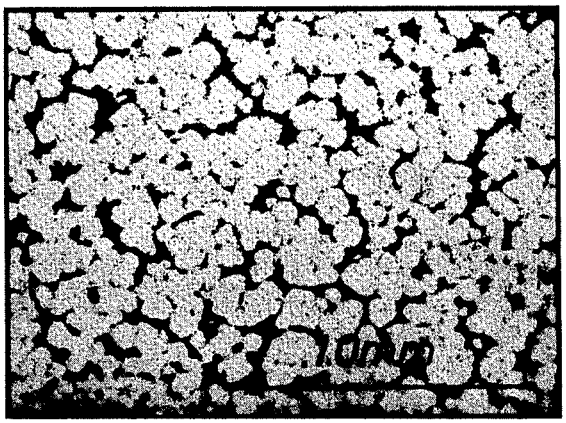

FIGS. 3 and 4 show the microstructure of samples of 1% carbon steel emergent from air cooled thick walled steel pipe operated in accordance with the invention. Further details of the test from which these samples were obtained are given in the Table below. FIG. 3 is at ×20 magnification and shows that the microstructure is fine and degenerate compared with that obtained by conventional casting methods. FIG. 4 is at ×50 magnification and shows the globular nature of the cast microstructure.

TABLE

| Pipe Inside Diameter (mm) | Pipe Outside Diameter (mm) | Pipe Length (mm) | Initial Steel Superheat (°C.) | Initial Steel Velocity (M/sec) |
|---|---|---|---|---|
| 63.5 | 114.3 | 2000 | +5 | 1.9 |

We claim:

1. A method of shaping steel having a final structure of substantially globular nature including the steps of transferring liquid steel from a containing vessel and/or delivery system to a shaping station through a hollow carrier; extracting heat from the steel as it passes through the hollow carrier; subjecting the steel to turbulent flow conditions as it passes through the hollow carrier and sustaining sufficient shear rate within the steel to maintain the fluidity and globular nature of the steel emergent therefrom; and passing the fluid steel directly from the hollow carrier to the shaping station.

2. A method as claimed in claim 1 wherein a shear rate of the order of 800 $sec^{-1}$ is sustained within the steel as it passes through the hollow carrier.

3. A method as claimed in claim 1 wherein the steel is a carbon steel.

4. A method as claimed in claim 1 wherein a portion only of the sensible superheat of the liquid steel is extracted during its passage through the hollow carrier.

5. A method as claimed in claims 1 wherein the shaping station comprises a rolling stand.

6. A method as claimed in claims 1 wherein the shaping station comprises a casting mould.

* * * * *